US010053913B2

(12) United States Patent
Forstner et al.

(10) Patent No.: US 10,053,913 B2
(45) Date of Patent: Aug. 21, 2018

(54) METHOD OF DETERMINING WHEN TOOL STRING PARAMETERS SHOULD BE ALTERED TO AVOID UNDESIRABLE EFFECTS THAT WOULD LIKELY OCCUR IF THE TOOL STRING WERE EMPLOYED TO DRILL A BOREHOLE AND METHOD OF DESIGNING A TOOL STRING

(71) Applicants: Ingo Forstner, Ahnsbeck (DE); Christian Linke, Wienhausen (DE)

(72) Inventors: Ingo Forstner, Ahnsbeck (DE); Christian Linke, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 912 days.

(21) Appl. No.: 14/483,463

(22) Filed: Sep. 11, 2014

(65) Prior Publication Data

US 2016/0076368 A1 Mar. 17, 2016

(51) Int. Cl.

| | |
|---|---|
| ***G06G 7/48*** | (2006.01) |
| ***E21B 7/00*** | (2006.01) |
| ***E21B 44/00*** | (2006.01) |

(52) U.S. Cl.

CPC ..... *E21B 7/00* (2013.01); *E21B 44/00* (2013.01)

(58) Field of Classification Search

CPC ..... E21B 7/00; E21B 44/00
USPC ..... 703/10
See application file for complete search history.

(56) References Cited

U.S. PATENT DOCUMENTS

| | | | | |
|---|---|---|---|---|
| 4,384,483 | A | 5/1983 | Dellinger et al. | |
| 5,560,439 | A * | 10/1996 | Delwiche | E21B 17/1078 175/325.1 |
| 6,021,377 | A * | 2/2000 | Dubinsky | E21B 7/068 702/9 |
| 6,205,851 | B1 * | 3/2001 | Jogi | E21B 44/005 175/39 |
| 6,206,108 | B1 * | 3/2001 | MacDonald | E21B 44/00 175/24 |
| 6,975,112 | B2 | 12/2005 | Morys et al. | |
| 7,114,578 | B2 | 10/2006 | Hutchinson | |
| 7,313,480 | B2 | 12/2007 | Chen et al. | |
| 7,987,926 | B2 | 8/2011 | Nichols et al. | |
| 8,014,987 | B2 | 9/2011 | Pabon et al. | |
| 8,214,188 | B2 | 7/2012 | Bailey et al. | |
| 8,453,764 | B2 | 6/2013 | Turner et al. | |
| 8,504,342 | B2 | 8/2013 | Bailey et al. | |

(Continued)

OTHER PUBLICATIONS

Leine et al. ("Stick-slip Whirl Interaction in Drillstring Dynamics", ASME, 2002, pp. 209-220).*

(Continued)

*Primary Examiner* — Omar Fernandez Rivas
*Assistant Examiner* — Iftekhar Khan
(74) *Attorney, Agent, or Firm* — Cantor Colburn LLP

(57) ABSTRACT

A method of determining when tool string parameters should be altered to avoid undesirable effects that would likely occur if the tool string were employed to drill a borehole includes, modeling portions or an entirety of the tool string in the borehole under steady state loading conditions, identifying deflections of the tool string with the modeling when buckling would occur for specific tool string parameters, and calculating whether whirl exhibiting similar deflections of the tool string to those identified during buckling would be undesirable.

20 Claims, 2 Drawing Sheets

(56) References Cited

U.S. PATENT DOCUMENTS

| | | | | |
|---|---|---|---|---|
| 8,589,136 | B2 | 11/2013 | Ertas et al. | |
| 2005/0071120 | A1* | 3/2005 | Hutchinson | E21B 47/04 702/150 |
| 2005/0197777 | A1* | 9/2005 | Rodney | E21B 7/04 702/9 |
| 2005/0279532 | A1* | 12/2005 | Ballantyne | E21B 47/12 175/40 |
| 2006/0065440 | A1 | 3/2006 | Hutchinson | |
| 2006/0195307 | A1 | 8/2006 | Huang et al. | |
| 2006/0260843 | A1* | 11/2006 | Cobern | E21B 47/024 175/45 |
| 2009/0095531 | A1* | 4/2009 | Pabon | E21B 7/00 175/56 |
| 2010/0082256 | A1* | 4/2010 | Mauldin | E21B 44/00 702/9 |
| 2012/0111633 | A1* | 5/2012 | Kumar | E21B 47/0006 175/50 |
| 2012/0130693 | A1 | 5/2012 | Ertas et al. | |
| 2012/0222900 | A1 | 9/2012 | Rodney et al. | |
| 2013/0049981 | A1 | 2/2013 | MacPherson et al. | |
| 2013/0054203 | A1* | 2/2013 | Herbig | E21B 44/00 703/2 |
| 2013/0098683 | A1 | 4/2013 | Turner et al. | |
| 2013/0124095 | A1* | 5/2013 | Sugiura | G06F 19/00 702/9 |
| 2013/0245950 | A1* | 9/2013 | Jain | E21B 47/00 702/9 |
| 2013/0248247 | A1* | 9/2013 | Sugiura | E21B 47/12 175/24 |
| 2014/0309978 | A1* | 10/2014 | Chen | E21B 41/00 703/7 |
| 2015/0083493 | A1* | 3/2015 | Wassell | E21B 44/00 175/40 |

OTHER PUBLICATIONS

Christoforou et al. ("Dynamic Modelling of Rotating Drillstrings With Borehole Interactions",Journal of Sound and Vibration (1997) 206(2), 243-260).*

Yigit et al. ("Coupled Torsional and Bending Vibrations of Drillstrings Subject to Impact With Friction", Journal of Sound and Vibration (1998) 215(1), 167-181).*

J.K. Vandiver et al., Case Studies of the Bending Vibration and Whirling Motion of Drill Collars; Society of Petroleum Engineers, SPE Paper No. 18652; Feb. 28, 1989; 14 pages.

Jason Christopher Wilkes, "A Perspective on the Numerical and Experimental Characteristics of Multi-Mode Dry-Friction Whip and Whirl"; from the internet at: http://repository.tamu.edu/; Aug. 2008; 76 pages.

Leine et al., "Stick-slip Whirl Interaction in Drillstring Dynamics"; Journal of Vibration and Acoustics, Apr. 2002, vol. 124; pp. 209-220.

M.W. Dykstra et al., "Improving Drilling Performance by Applying Advanced Dynamics Models"; Society of Petroleum Engineers, SPE Paper No. 67697; Feb. 27, 2001; 18 pages.

Notification of Transmittal of the International Search Report and the Written Opinion of the International Searching Authority; PCT/US2015/048490; dated Nov. 23, 2015; ISR 7 pages, WO 7 pages.

Richard Duff, "An Experimental and Computational Investigation of Rotating Flexible Shaft System Dynamics in Rotary Drilling Assemblies for Down Hole Drilling Vibration Mitigation"; from the Internet at: http://etd.lsu.edu/; Aug. 2013; 184 pages.

Rong-Juin Shyu., "Bending Vibration of Rotating Drill Strings"; Ph.D. Thesis; Massechusetts Institute of Technology; Aug. 1989; 145 pages.

* cited by examiner

METHOD OF DETERMINING WHEN TOOL STRING PARAMETERS SHOULD BE ALTERED TO AVOID UNDESIRABLE EFFECTS THAT WOULD LIKELY OCCUR IF THE TOOL STRING WERE EMPLOYED TO DRILL A BOREHOLE AND METHOD OF DESIGNING A TOOL STRING

BACKGROUND

Whirl is a dynamic condition that can be experienced during rotational operation of a tool string in a borehole, such as while drilling a borehole into an earth formation, for example. Depending upon operational parameters the whirl can be damaging to the tool string and as such operators frequently try to avoid whirl completely. This approach, if successful at avoiding whirl, achieves its desired objective. However, new methods and systems that deal with avoiding undesirable effects associated with whirl are of interest to those who practice in the art.

BRIEF DESCRIPTION

Disclosed herein is a method of determining when tool string parameters should be altered to avoid undesirable effects that would likely occur if the tool string were employed to drill a borehole. The method includes, modeling portions or an entirety of the tool string in the borehole under steady state loading conditions, identifying deflections of the tool string with the modeling when buckling would occur for specific tool string parameters, and calculating whether whirl exhibiting similar deflections of the tool string to those identified during buckling would be undesirable.

Further disclosed herein is a method of designing a tool string. The method includes, modeling the tool string, applying simulated loads at steady state on the tool string as modeled that create buckling, determining whether whirl of the tool string with a similar deflection and contact force distribution as simulated buckling will be undesirable, and setting design parameters that allow buckling of the modeled tool string as long as whirling at similar deflection and contact force distribution as simulated buckling is not undesirable.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
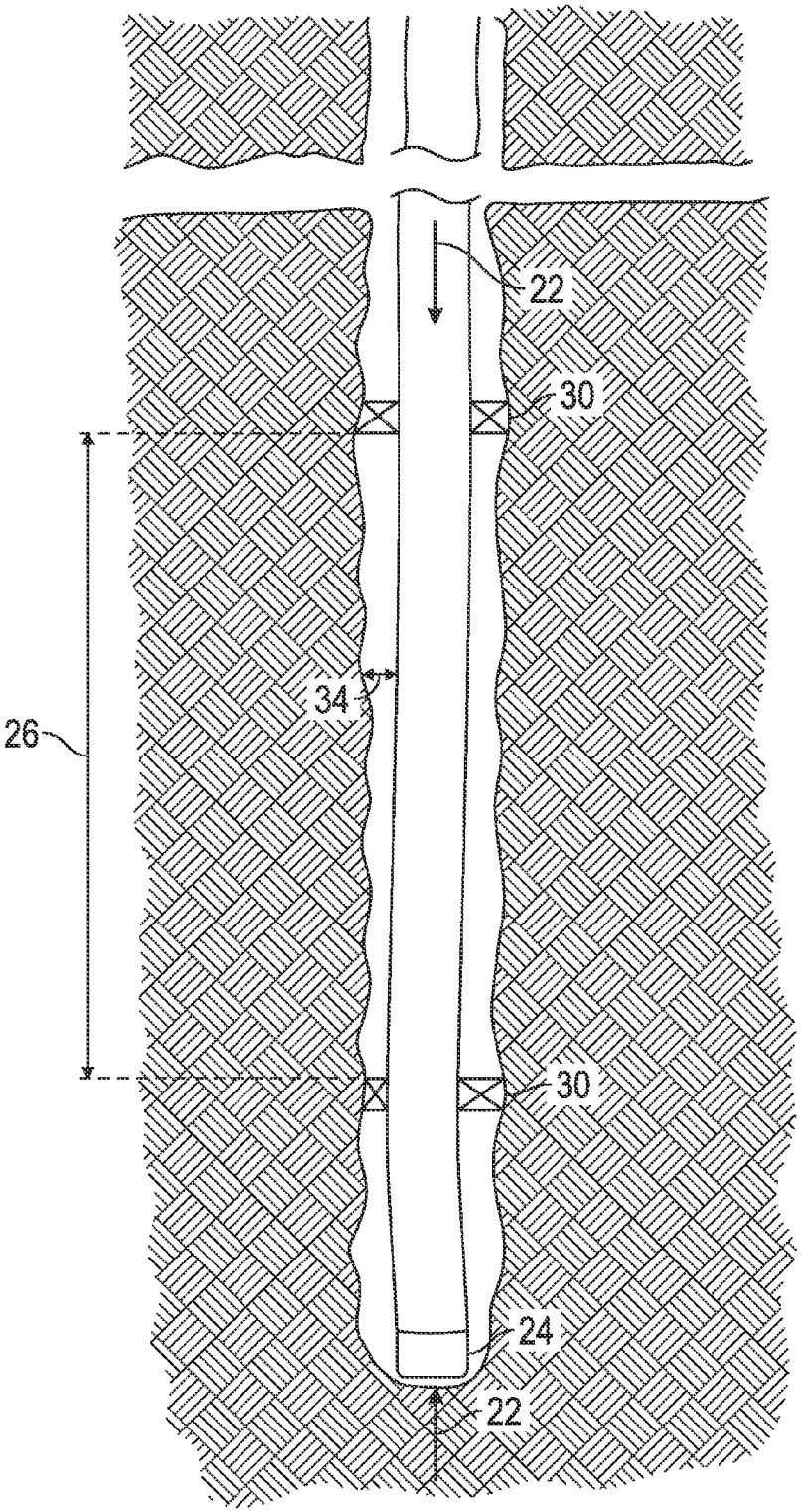
FIG. 1 depicts a schematical cross sectional view of a tool string within a borehole.
Figure 2:
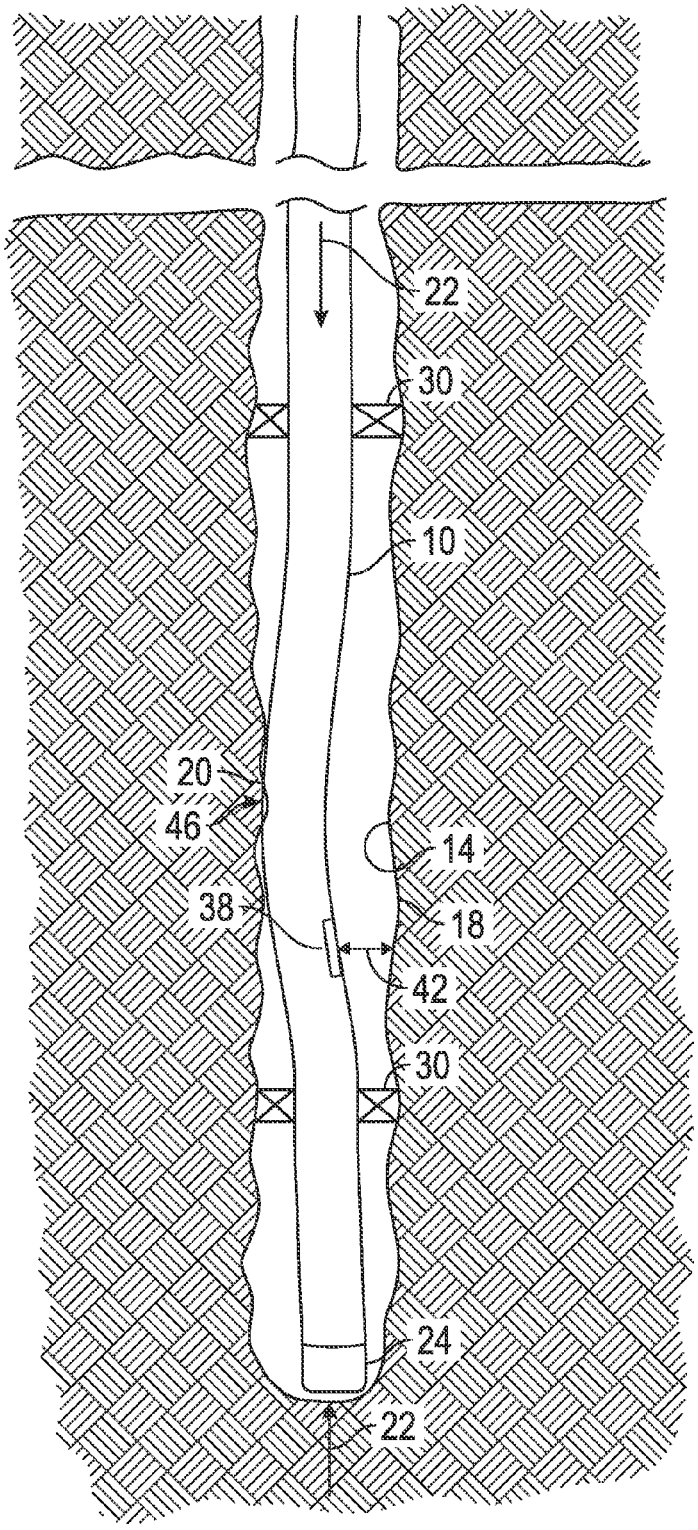
FIG. 2 depicts a similar schematical cross sectional view of the tool string within the borehole with the tool string being shown in a deformed condition.

Referring to FIGS. 1 and 2, buckling of a tool string 10, such as a drill string or drill pipe, occurs when the tool string 10 has deformed in bending to a point where the tool string 10 makes contact with walls 14 of a borehole 18, for example. This can occur under static or steady state conditions, such as when the tool string 10 is not rotating, for example. If the tool string 10 is rotating relative to the borehole 18 and contact is made between the tool string 10 and the walls 14 a dynamic condition known as whirl can occur. Whirl is when the tool string 10 continues to make contact with the walls 14 while it is rotating and the contact point 20 between the tool string 10 and the walls 14 also rotates. The whirl can be in a forward or a backward direction depending upon the direction of rotation of the contact point 20 relative to the direction of rotational of the tool string 10 itself. Whirling can have detrimental effects on operations and in such cases may be undesirable. Undesirable conditions include excess bending fatigue, excess dynamic wall contact forces (these can create frictional wear and impact loading on the string and damage to the borehole wall), and sensor measurement accuracy degradation and sensor damage, for example. The impact forces can be based on assumptions, estimates, measurements, or analytically derived values of lateral acceleration inside the borehole 18 and at surfaces of the walls 14. However, not all whirl necessarily causes all or even any of these undesirable conditions. Determining when whirl is likely to cause these undesirable conditions can be helpful in deciding whether to allow operations to continue even while whirl continues or to alter operating parameters to lessen the undesirable conditions. It can also be helpful in planning the design of a tool string by choosing a design that exhibits no or limited undesirable effects in cases where whirl may develop.

Embodiments disclosed herein include a method of determining when parameters of the tool string 10 should be altered to avoid undesirable effects and providing guidance on altering parameters of the tool string 10 to avoid undesirable conditions. One embodiment includes modeling portions or the entirety of the tool string 10 relative to the borehole 18 in steady state loading conditions, identifying from the modeling if buckling would occur under the steady state loading conditions and how the resulting deflections would look, calculating whether whirl with similar deflections and load conditions as the steady state loading conditions defined by the modeled buckling shape would be undesirable.

Several factors contribute to whether buckling will occur and contributions of such factors can be calculated. For example, axial compression of the tool string 10, expressed by arrows 22 in the Figures, adds to weight of the tool string 10 in determining a weight applied to a drill bit 24 when the tool string 10 is a drill string used for drilling, for example. This weight on bit or WOB can be a major contributor to buckling in applications where the tool string 10 includes a bottom hole assembly, for example. Another factor is a longitudinal dimension 26 between adjacent stabilizers 30 or centralizers. Typically the greater the dimension 26 the greater the likelihood that buckling will occur. Having a tool string 10 with a large dimension 26, however, can result in less stress in the tool string 10 if only a single one of the contact points 20 exists during whirl since the greater dimension 26 means a larger radius of curvature in the tool string 10. A further factor is diametrical dimensions of the stabilizers 30 and portions of the tool string 10 in between the stabilizers 30. Typically the smaller the outer diameter and the greater the inner diameter of the portions, the greater the likelihood that buckling will occur. Stated another way, a decrease in stiffness of a portion of the tool string 10 between stabilizers 30 the greater the likelihood that buckling will occur. Assumptions can be made regarding curvature of the tool string 10 relative to the dimension 26 with one assumption being that just the single contact point 20 occurs at approximately midway between adjacent stabilizers 30 that define the dimension 26. Radial clearance 34 between the tool string 10 and the borehole walls 18 can also be a factor. The smaller the radial clearance 34 is the more likely buckling is to occur since less radial deformation of the tool string 10 is required before it contacts the walls 14. However, undesirable conditions may also be lessened in systems wherein the radial clearance 34 is small since loads associated with contact between the tool string 10 and the walls 14 may also be less. Sagging of the tool string 10 due to weight of the tool string 10 in deviated and horizontal portions of the borehole 18 (such as when the borehole 18 is a wellbore in an earth formation, for example), also contributes to buckling. All other things being equal, the greater the sagging the more likely buckling will occur. By modeling these and other parameters with finite element modeling software, for example, calculations can be made to determine at what point buckling will occur and what deflection shapes are likely. Additionally, the accuracy of the modeling and calculations can be improved by analyzing and incorporating results taken empirically. Additionally, variations in the foregoing parameters can be modeled to determine their individual contributions to the deflection shapes.

The foregoing modeling allows an operator to determine load conditions experienced by the tool string 10. These include such parameters as the stress in the tool string 10 due to bending that results in the buckling and force applied between the tool string 10 and the walls 14 at the contact point 20 therebetween, for example. Calculations can be made employing these parameters to determine whether whirl of a similar deflection geometry as those that create buckling will be undesirable and thus be allowed or not. A curvature of the borehole 14 can also be factored into the calculations since such curvature will contribute to the bending loads in the tool string 10.

For example, whirl creates cyclic bending of the tool string 10. In fact, backwards whirl can cause ten or more whirl rotations for each rotation of the tool string 10. This directly correlates to 10 or more bending cycles of the tool string 10 for each rotation of the tool string 10. By knowing the amount of bending stress that the whirl would cause in the tool string it can be calculated whether fatigue failure of the tool string 10 will likely occur over a specific period of operation. Whirl deflections can be similar to buckling deflections for the same tool string 10. Therefore bending loads, contact forces, deflections, and lateral misalignment can be estimated for whirl events by reviewing one or more buckling shapes of the tool string 10. If these calculations predict that undesirable fatigue conditions would likely occur then directions can be provided as to the steady state loading parameters that can be altered to a level wherein the calculation predicts acceptable fatigue conditions of the tool string 10. Altering the radial clearance 34 to a smaller value to decrease stress generated in the tool string 10 during each bending cycle is one such alterable parameter that guidance can be provided for. This reduction in bending stress can be to a level that the tool string 10 may undergo essentially an infinite number of bending cycles without causing significant fatigue concerns.

Another alterable parameter that can decrease loads in the tool string 10 due to bending is changing the dimension 26 between adjacent stabilizers 30. All other things being equal, including stiffness of the tool string 10, for example, may allow an increase in the dimension 26 to decrease bending stress in the tool string 10.

A different alteration could be employed in instances where accuracy of one or more sensors 38 disposed at the tool string 10 is negatively affected by whirl. These inaccuracies can be calculated and may be due to changes in a dimension 42 between the sensor 38 and the walls 14 as well as other relationships between the sensor 38 and the walls 14, such as, curvature, speed and angle, for example. Such changes in the dimension 42 may be due to the displacement of a portion of the tool string 10 where the sensor 38 is located moving an axis of the tool string 10 off center of the borehole 18. For example, in embodiments wherein the sensor 38 is located near a surface of the tool string 10 whirl can cause the dimension 42 to change with every whirl rotation. An alteration that decreases the radial clearance 34 therefore can lessen the variations to the dimension 42 caused by whirl. Another alteration that can decrease variability in a value of the dimension 42 includes relocating the sensor 38 nearer to one of the stabilizers 30. In so doing the amount an axis of the tool string 10 deviates from a center of the borehole 18 decreases for a given bend radius of the tool string 10.

Another example of an undesirable condition relates to friction between the tool string 10 and the walls 14. Frictional wear of the tool string 10 can be proportional to, among other things, the normal force between the tool string 10 and the walls 14 at the contact point 20. These normal forces at a plurality of the contact points 20 can be calculated individually or cumulatively. The normal forces can be calculated quite accurately under steady state loading conditions that cause buckling. By assuming these normal forces are similar during whirl as they are during buckling frictional wear of the tool string 10 can be calculated. These calculations include extrapolating a relative distance traveled between a surface 46 of the tool string 10 and the walls 14 at the contact point 20 that will occur due to whirl.

Friction between the tool string 10 and the walls 14 can also cause issues with integrity of the wellbore 18 as well as causing problems with torque or drag.

Frictional engagement between the tool string 10 and the walls 14 can also cause excess vibration in the tool string 10 that can negatively affect accuracy of the sensor 38 or can damage the sensor 38. The likelihood and severity of such damage in case of whirl can be estimated from buckling simulation.

Alternately, instead of using a steady-state worst case bending scenario derived from modeling in the planning phase or in realtime, the whirl and bending load measurements at one position in the tool string 10 are extrapolated to the entire tool string 10. This can include scaling the worst case bending load distribution to one that matches the measured bending load at the one position. Or optionally considering whirl frequency or bending load frequency as a multiplier of the severity. As such, instead of just stating that whirl is acceptable or undesirable, bending load and contact force distribution values (along with the whirl frequency) could be quantified to generate a whirl severity index. With statistical offset data, statements like "expect twist-off in about 30 minutes at these parameters" could be made. Although this has been described in relation to the tool string 10 used for drilling, it can relate to any string inside a long hole that is rotating, such as, a casing or liner, a drillpipe higher above in the string, a milling BHA, a workover BHA, and a long bore drilling in the workshop, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of determining when tool string parameters should be altered to avoid undesirable effects that would likely occur if the tool string were employed to drill a borehole, comprising:

modeling portions or an entirety of the tool string in the borehole under steady state loading conditions;

identifying deflections of the tool string with the modeling when the tool string has deformed in bending to a point where the tool string makes contact with walls of the borehole;

determining a bending stress caused by the bending to a point where the tool string makes contact with walls of the borehole;

calculating, based on the bending stress caused by the bending to a point where the tool string makes contact with walls of the borehole, whether fatigue failure of the tool string will likely occur; and altering at least one of the tool string physical parameters to a level wherein the calculation predicts acceptable fatigue conditions of the tool string.

2. The method of claim 1, further comprising varying the specific tool string parameters during the modeling using a computer model of the portions or the entirety of the tool string to provide input for altering at least one of the tool string physical parameters.

3. The method of claim 1, further comprising determining a contribution that a dimension between adjacent stabilizers has to the bending to a point where the tool string makes contact with walls of the borehole.

4. The method of claim 1, further comprising determining a contribution that radial clearance between the tool string and walls of the borehole has to the bending to a point where the tool string makes contact with walls of the borehole.

5. The method of claim 1, further comprising calculating where the tool string will make contact with walls of the borehole.

6. The method of claim 1, further comprising calculating individual and/or cumulative normal forces between the tool string and walls of the borehole.

7. The method of claim 1, further comprising calculating fatigue of the tool string.

8. The method of claim 1, further comprising calculating frictional wear of the tool string against walls of the borehole.

9. The method of claim 1, further comprising calculating impact forces between the tool string and walls of the borehole using assumptions, estimates, measurements, and analytically derived values of lateral acceleration.

10. The method of claim 1, further comprising calculating inaccuracies of at least one sensor disposed in the tool string due to variations in a relationship between the at least one sensor and walls of the borehole.

11. The method of claim 1, further comprising calculating damage to at least one sensor disposed in the tool string.

12. The method of claim 1, further comprising assuming the whirl is backwards whirl.

13. The method of claim 1, wherein portions of the tool string modeled include a bottom hole assembly positioned within a borehole in an earth formation.

14. A method of designing a tool string comprising:

modeling the tool string;

applying simulated loads at steady state on the tool string as modeled that create simulated bending to a point where the tool string makes contact with walls of the borehole;

determining a bending stress caused by the bending to a point where the tool string makes contact with walls of the borehole;

calculating, based on the bending stress caused by the bending to a point where the tool string makes contact with walls of the borehole, whether fatigue failure of the tool string will likely occur; and altering at least one of the tool string physical parameters to a level wherein the calculation predicts acceptable fatigue conditions of the tool string.

15. The method of claim 14, further comprising modeling the tool string with finite element analysis.

16. The method of claim 14, wherein the setting design parameters includes setting dimensions of stabilizers on the tool string.

17. The method of claim 14, wherein the setting design parameters includes setting dimensions between adjacent stabilizers along the tool string.

18. The method of claim 14, wherein the setting design parameters includes setting a dimensions between a sensor and a stabilizer.

19. The method of claim 14, wherein the setting design parameters includes setting stiffness of a portion of the tool string.

20. The method of claim 14, wherein the setting design parameters includes setting clearance between the tool string and walls of a borehole.

* * * * *